US012674452B2

(12) United States Patent
Poehls et al.

(10) Patent No.: US 12,674,452 B2
(45) Date of Patent: Jul. 7, 2026

(54) MODULAR PLUNGER PACKING GLAND ASSEMBLY

(71) Applicant: SPM Oil & Gas Inc., Fort Worth, TX (US)

(72) Inventors: Justin Lane Poehls, Glen Rose, TX (US); Connor Robert Landrum, Burleson, TX (US); David Theodore Figgs, Fort Worth, TX (US)

(73) Assignee: Caterpillar Inc. Joint OC, Peoria, IL (US)

( * ) Notice: Subject to any disclaimer, the term of this patent is extended or adjusted under 35 U.S.C. 154(b) by 288 days.

(21) Appl. No.: 17/907,078

(22) PCT Filed: Mar. 26, 2021

(86) PCT No.: PCT/US2021/024498

§ 371 (c)(1),
(2) Date: Sep. 22, 2022

(87) PCT Pub. No.: WO2021/195572

PCT Pub. Date: Sep. 30, 2021

(65) Prior Publication Data

US 2024/0209851 A1 Jun. 27, 2024

Related U.S. Application Data

(60) Provisional application No. 63/002,281, filed on Mar. 30, 2020, provisional application No. 63/000,461, filed on Mar. 26, 2020.

(51) Int. Cl.
*F04B 53/02* (2006.01)
*E21B 43/26* (2006.01)
(Continued)

(52) U.S. Cl.
CPC ..... *F04B 53/02* (2013.01); *F04B 53/164* (2013.01); *F04B 53/18* (2013.01); *E21B 43/2607* (2020.05);
(Continued)

(58) Field of Classification Search
CPC ..... F04B 53/02; F04B 53/164; F04B 53/18; F04B 19/22; F04B 47/00; F04B 53/008;
(Continued)

(56) References Cited

U.S. PATENT DOCUMENTS 3,870,439 A * 3/1975 Stachowiak ..... F04B 53/00 417/454
4,277,229 A * 7/1981 Pacht ..... F04B 53/164 417/454
(Continued)

FOREIGN PATENT DOCUMENTS

CN 201292942 Y 8/2009

OTHER PUBLICATIONS

International Search Report and Written Opinion issued in Application No. PCT/US2021/024498; Dated Jul. 12, 2021, 8 Pages.

*Primary Examiner* — David N Brandt

(57) ABSTRACT

A modular plunger packing gland assembly for a plunger of a hydraulic frac pump is disclosed. The modular plunger packing gland assembly includes an annular packing nut configured to be disposed circumferentially about the plunger and proximate a plurality of annular seals disposed about the plunger, and an annular packing gland having an inner circumferential threaded interface configured to engage an external circumferential thread defined on the packing nut. The annular packing gland further defines a plurality of threaded openings configured to receive a plurality of threaded bolts configured to securely fasten the annular packing gland and the packing nut to the pump.

13 Claims, 4 Drawing Sheets

(51) Int. Cl.

| | |
|---|---|
| ***F04B 19/22*** | (2006.01) |
| ***F04B 47/00*** | (2006.01) |
| ***F04B 53/00*** | (2006.01) |
| ***F04B 53/16*** | (2006.01) |
| ***F04B 53/18*** | (2006.01) |
| ***F04B 53/22*** | (2006.01) |

(52) U.S. Cl.
CPC ..... *F04B 19/22* (2013.01); *F04B 47/00* (2013.01); *F04B 53/008* (2013.01); *F04B 53/168* (2013.01); *F04B 53/22* (2013.01)

(58) Field of Classification Search
CPC ..... F04B 53/166; F04B 53/168; F04B 53/22; E21B 43/2607
See application file for complete search history.

(56) References Cited

U.S. PATENT DOCUMENTS

| | | | | |
|---|---|---|---|---|
| 5,727,793 | A | 3/1998 | Gosselin | |
| 2011/0308967 | A1* | 12/2011 | Byrne | C23F 13/06 204/196.15 |
| 2012/0152111 | A1 | 6/2012 | Byrne et al. | |
| 2019/0017503 | A1* | 1/2019 | Foster | F04B 1/16 |
| 2019/0093616 | A1 | 3/2019 | Klein et al. | |
| 2019/0136842 | A1* | 5/2019 | Nowell | F04B 1/0461 |
| 2019/0360483 | A1* | 11/2019 | Nowell | F04B 53/22 |

* cited by examiner

MODULAR PLUNGER PACKING GLAND ASSEMBLY

CROSS-REFERENCE TO RELATED APPLICATIONS

This Patent Application is a 371 national stage of PCT Application No. PCT/US2021/024498 filed on Mar. 26, 2021, entitled "MODULAR PLUNGER PACKING GLAND ASSEMBLY," which claims priority to U.S. Provisional Application No. 63/000,461, filed on Mar. 26, 2020, entitled "MODULAR PLUNGER PACKING GLAND ASSEMBLY," and to U.S. Provisional Application No. 63/002,281, filed on Mar. 30, 2020, entitled "MODULAR PLUNGER PACKING GLAND ASSEMBLY." The disclosures of the prior Applications are considered part of and are incorporated by reference into this Patent Application.

FIELD

The present disclosure relates to hydraulic fracturing pumps, and in particular, to a modular plunger packing glad assembly.

BACKGROUND

Hydraulic fracturing (a.k.a. fracking) is a process to obtain hydrocarbons such as natural gas and petroleum by injecting a fracking fluid or slurry at high pressure into a wellbore to create cracks in deep rock formations. The hydraulic fracturing process employs a variety of different types of equipment at the site of the well, including one or more positive displacement pumps, slurry blender, fracturing fluid tanks, high-pressure flow iron (pipe or conduit), wellhead, valves, charge pumps, and trailers upon which some equipment are carried.

Positive displacement pumps are commonly used in oil fields for high pressure hydrocarbon recovery applications, such as injecting the fracking fluid down the wellbore. A positive displacement pump typically has two sections, a power end and a fluid end. The power end includes a crankshaft powered by an engine that drives the plungers. The fluid end of the pump includes cylinders into which the plungers operate to draw fluid into the fluid chamber and then forcibly push out at a high pressure to a discharge manifold, which is in fluid communication with a well head. A seal assembly, also called a packing, packing assembly, or stuffing box, disposed in the cylinder chamber of the pump housing, is used to prevent leakage of frac fluid from around the plunger during pumping operations.

DETAILED DESCRIPTION

Conventional seal packing technology utilizes several different types of metallic and/or elastomer seal components inserted into a stuffing box during installation into the fluid end. This seal stack is energized by a packing nut that is also installed in machined contours and threads in the fluid end. The packing nut preloads the seals to insure positive engagement with the plunger. The conventional plunger packing gland and stuffing box is installed in grooves machined in the fluid end, including the threads for the packing nut. The conventional packing around the plunger typically only lasts around 100 hours during down hole operation. Because the packing seals require mechanical compression exerted by the packing nut to energize or pre-load the seal packing to insure a constant contact with the plunger and seal bore, the seals can wear prematurely if the packing nut is not installed or maintained properly. Further, the threads on the packing nut can fail prematurely. This type of failure is detrimental and requires significant labor and cost to repair, with the worst scenario requiring a complete replacement of the pump fluid end.

Figure 1:
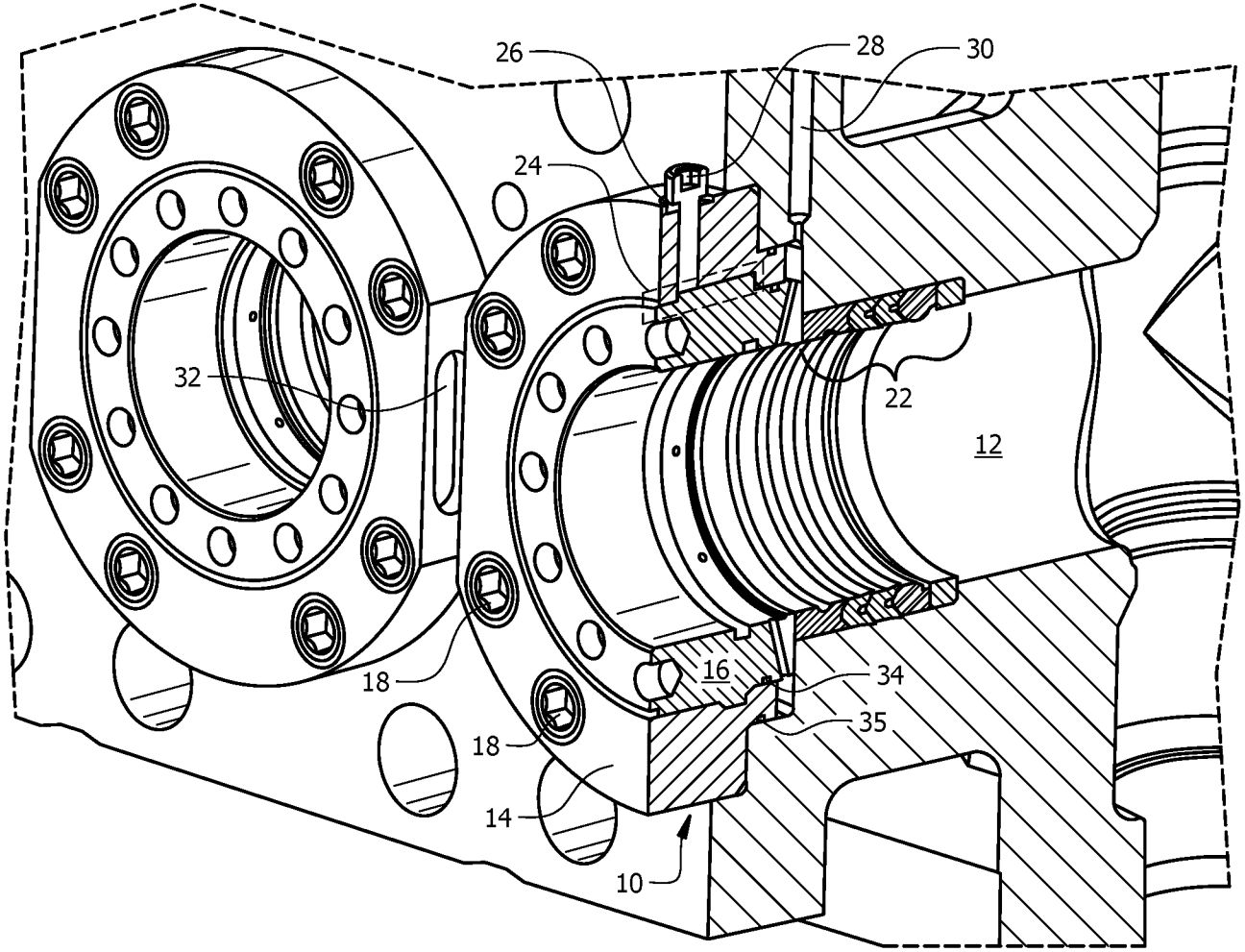
FIG. 1 is a cross-sectional perspective view of an exemplary embodiment of a modular plunger packing gland assembly for the fluid end of a positive displacement frac pump according to the teachings of the present disclosure.
Figure 4:
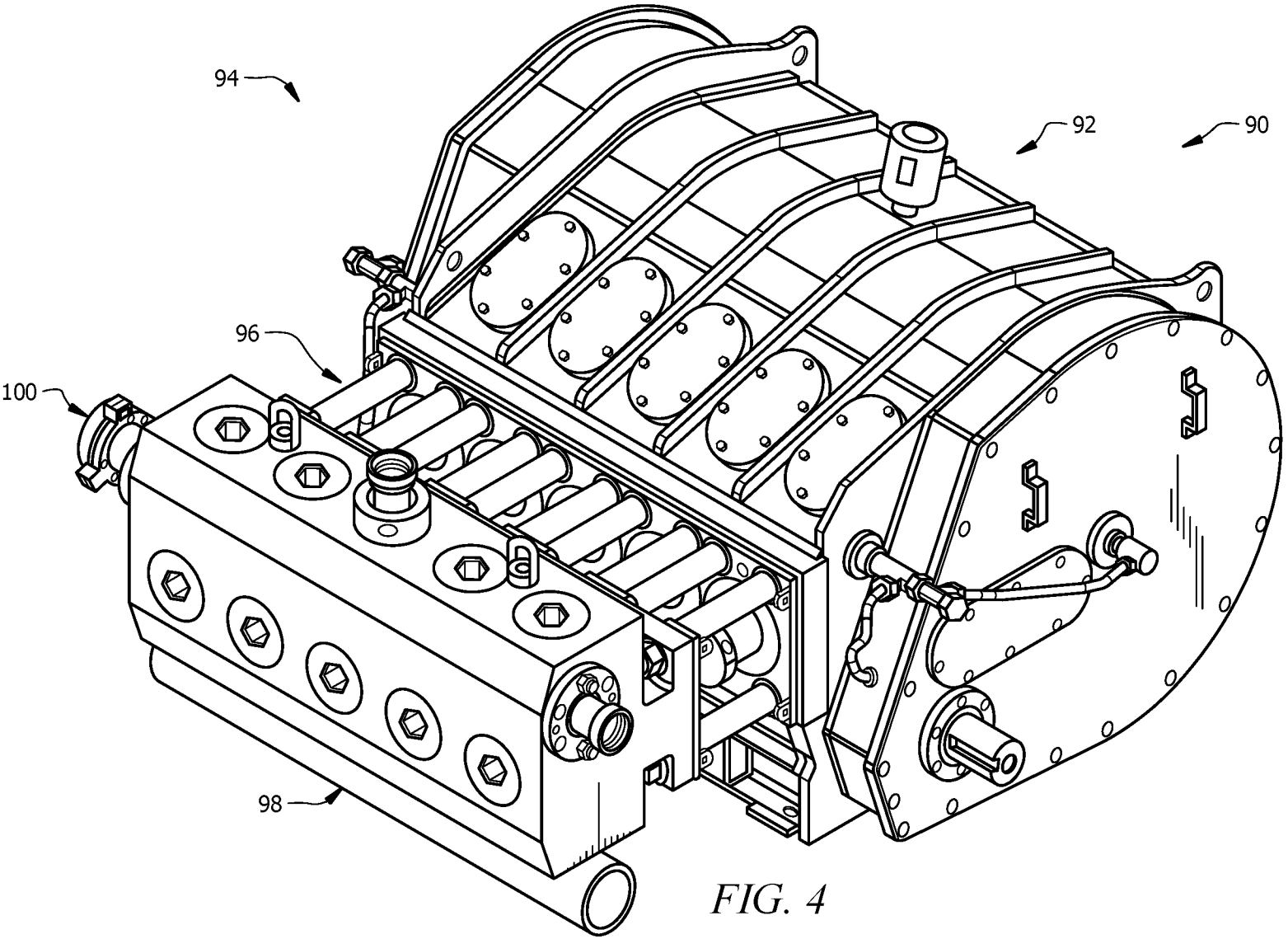
FIG. 4 is a perspective view of an exemplary embodiment of a positive displacement pump according to the teachings of the present disclosure.

FIG. 1 is a cross-sectional perspective view of a novel modular packing gland and packing nut assembly 10 for a plunger bore 12 in a fluid end of a pump (FIG. 4). The innovation described herein is to eliminate the packing nut threads from the fluid end. Instead, a modular unit having a packing gland 14 and a packing nut 16 is fastened to the fluid end using threaded fasteners, such as bolts or socket head cap screws (SHCS) 18. As shown in FIG. 1, the sealing elements 20 in the packing assembly (stuffing box) 22 is disposed in the plunger bore 12 in the fluid end and energized by the packing nut 16 that is held in place by the packing gland 14 that is bolted in place to the fluid end. The interface 24 between the packing nut 16 and the packing gland 14 can be threaded, for example, using standard stub ACME threads or another suitable thread configuration. The interface between the packing gland and the packing nut can also incorporate interference fit. The packing gland 14 includes a plurality of openings that receives threaded fasteners 18 organized in an offset pattern for stress distribution and clearance reasons are distributed about the plunger bore opening. One or more threaded openings 26 may be formed in the packing gland 14 to receive a locking pin 28 to prevent any rotational movement relatively between the packing nut 16 and the packing gland 14. A lubrication port and passageway 30 may be incorporated in the packing gland 14 and packing nut 16 for supplying a clean lubrication fluid to the packing seals 20. The outer perimeter of the packing gland may be formed or machined in the packing gland 14 to provide clearance 32 between adjacent packing glands 14 to facilitate assembly and disassembly. One or more grooves 34 and 35 are further defined in the packing nut and packing gland to accommodate sealing lubrication.

Figure 2:
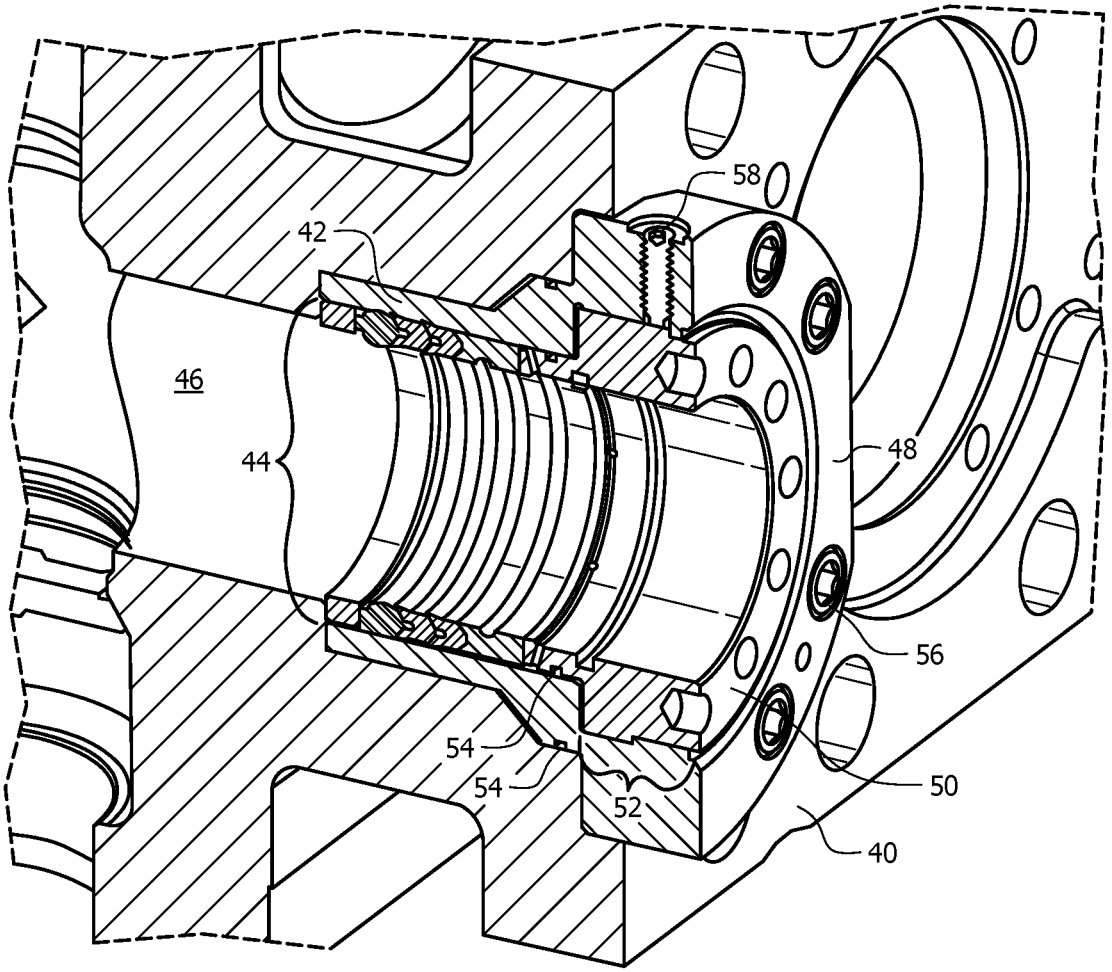
FIG. 2 is a cross-sectional perspective view of an exemplary embodiment of a modular plunger packing gland assembly with an integrated sleeve.

In an alternate design as shown in FIG. 2, a modular packing gland assembly 40 that incorporates a sleeve 42 is deployed between the packing assembly 44 and the inner wall of the plunger bore 46. The packing sleeve 42 includes an internal passage that accommodates the plunger (not explicitly shown) as it reciprocates within the internal passage and the plunger bore 46, during operation of the reciprocating pump. The modular packing gland assembly 40 includes a sleeve 42 integrated with the packing gland 48 and packing nut 50. The sleeve 42 includes an inner wall that defines the internal passage and the packing 44 is received within the internal passage of the sleeve 42 such that the packing 44 extends radially between an exterior surface of the plunger and the inner wall of the sleeve 42. The packing sleeve 42 holds the packing 44 within the internal passage of the sleeve 42 and the packing 44 in turn holds the plunger within the internal passage. The packing 44 thereby seals the radial gap defined between the plunger and the inner wall of the sleeve 42 to facilitate sealing the plunger within the plunger bore 46 of the fluid cylinder. As before, an interface between the packing gland 48 and the packing nut 50 is a threaded interface 52. One or more grooves 54 are defined in the packing nut and sleeve outer circumference to accommodate sealing lubrication. The bolt-on packing gland 48 thus secures both the packing sleeve 42 as well as the packing nut 50 within the plunger bore 46. Similar to the embodiment described above, the packing gland 48 includes a plurality of openings that receives threaded fasteners 56 organized in an offset pattern about the plunger bore opening for stress distribution and clearance reasons. One or more threaded openings may be formed in the packing gland 48 to receive a locking pin 58 to prevent any rotational movement relatively between the packing nut 50 and the packing gland 48. A lubrication port and passageway may be incorporated in the packing gland and packing nut for supplying a clean lubrication fluid to the packing seals. The outer perimeter of the packing gland may be formed or machined in the packing gland 14 to provide clearance between adjacent packing glands to facilitate assembly and disassembly. One advantage of the integrated packing gland and sleeve is the case of assembly because fewer parts are needed to be assembled in correct alignment and positioning.

Figure 3:
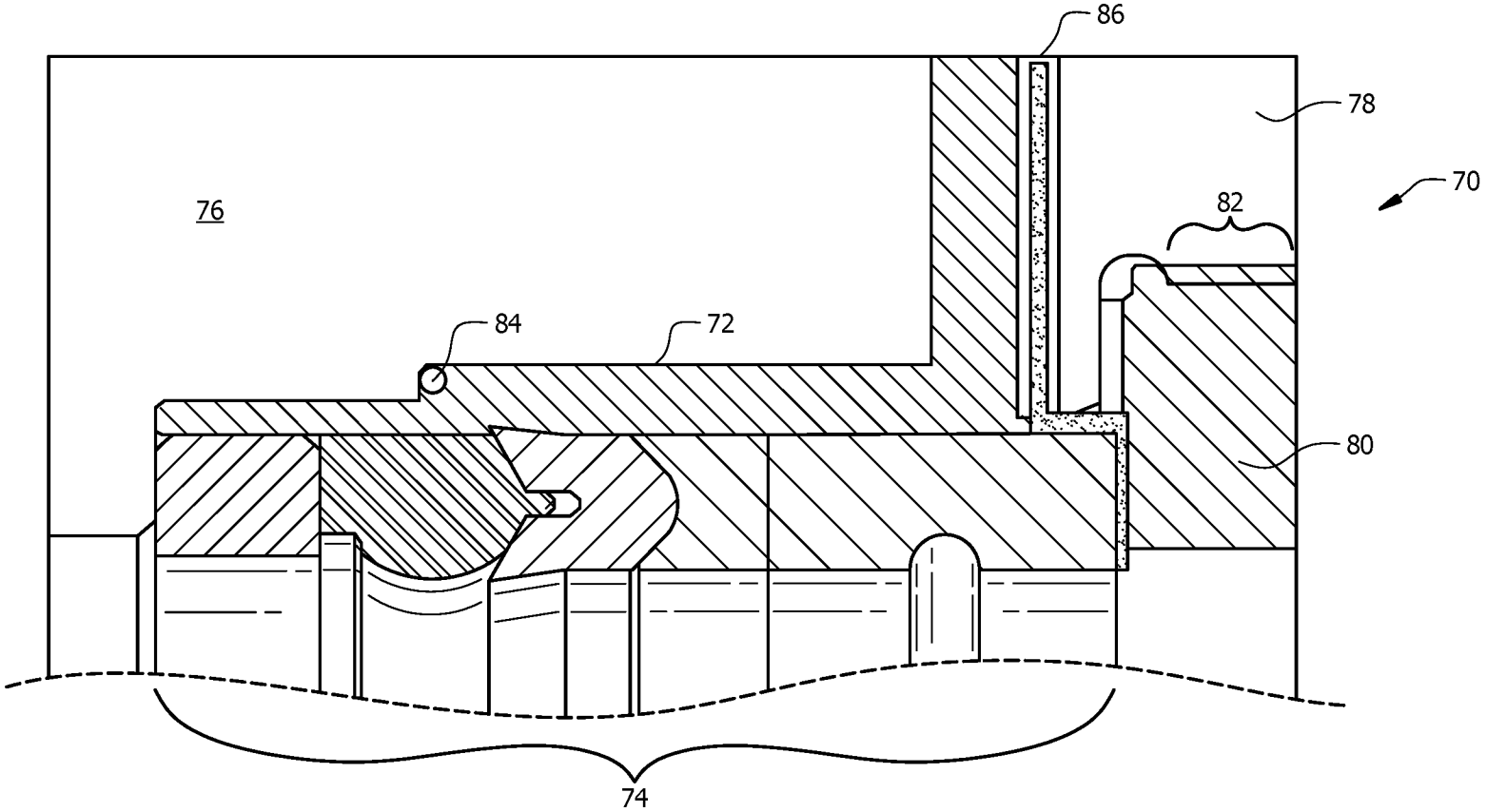
FIG. 3 is a cross-sectional side view of another embodiment of a modular plunger packing gland assembly with a sleeve assembly.

FIG. 3 is a cross-sectional side view of another embodiment of a modular packing gland assembly 70 with an integrated sleeve 72. Modular packing gland assembly 70 incorporates a plunger sleeve 72 that is disposed between the packing assembly 74 and the fluid cylinder 76. The packing sleeve 72 includes an internal passage that accommodates the plunger (not explicitly shown) as it reciprocates within the internal passage and the plunger bore, during operation of the reciprocating pump. The modular packing gland assembly 70 includes a sleeve 72 integrated with the packing gland 78 and packing nut 80. The sleeve 72 includes a rounded corner in its distal end and an inner wall that defines the internal passage and the packing 74 is received within the internal passage of the sleeve 72 such that the packing 74 extends radially between an exterior surface of the plunger and the inner wall of the sleeve 72. The packing sleeve 72 holds the packing 74 within the internal passage of the sleeve 72 and the packing 74 in turn holds the plunger within the internal passage. The packing 74 thereby seals the radial gap defined between the plunger and the inner wall of the sleeve 72 to facilitate sealing the plunger within the plunger bore of the fluid cylinder 76. The packing 74 may include a number of sealing elements such as junk ring, header ring, pressure ring, adapter ring, and spacer ring. As before, an interface between the packing gland 78 and the packing nut 80 is a threaded interface 82. Further disposed between the sleeve 72 and the fluid cylinder is a metal O-ring 84 that may be, for example, a face/split gland seal or another seal configuration. The bolt-on packing gland assembly thus secures the packing sleeve 72 as well as the packing nut 80 within the plunger bore. Similar to the embodiment described above, the packing gland 78 includes a plurality of openings that receives threaded fasteners that secure the modular packing gland assembly in the fluid end. The fastener openings may be organized in an offset pattern about the plunger bore opening for stress distribution and clearance reasons. Further, one or more threaded openings may be formed in the packing gland 78 to receive a locking pin to prevent relative rotational movement between the packing nut 80 and the packing gland 78. A lubrication port and passageway 86 may be incorporated in the packing gland and packing nut for supplying a clean lubrication fluid to the packing seals 74. As described above, parallel slots may be formed or machined in the packing gland 78 to provide clearance between adjacent packing glands to facilitate assembly and disassembly. Because the plunger sleeve is integrated as part of the unit, an advantage of this embodiment of the modular packing gland is the ease of assembly because fewer parts are needed to be assembled in correct alignment and positioning.

FIG. 4 is a pictorial representation of an exemplary positive displacement pump 90 that may incorporate the modular packing gland assemblies described herein. The positive displacement pump 90 has two sections, a power end 92 and a fluid end 94. The fluid end 94 of the pump 90 includes a fluid end block or fluid cylinder, which is connected to the power end housing via a plurality of stay rods 96. In operation, the crankshaft (not explicitly shown) reciprocates a plunger rod assembly between the power end 92 and the fluid end 94. The crankshaft is powered by an engine or motor (not explicitly shown) that drives a series of plungers (not explicitly shown) to create alternating high and low pressures inside a fluid chamber. The cylinders operate to draw fluid from a suction manifold 98 into the fluid chamber and then discharge the fluid at a high pressure to a discharge manifold 100. The discharged liquid is then injected at high pressure into an encased wellbore. The injected fracturing fluid is also commonly called a slurry, which is a mixture of water, proppants (silica sand or ceramic), and chemical additives. The pump 90 can also be used to inject a cement mixture down the wellbore for cementing operations. The pump 90 may be freestanding on the ground, mounted to a skid, or mounted to a trailer.

The features of the present invention which are believed to be novel are set forth below with particularity in the appended claims. However, modifications, variations, and changes to the exemplary embodiments described above will be apparent to those skilled in the art, and the modular packing gland assembly for the fluid end of a reciprocating pump described herein thus encompasses such modifications, variations, and changes and are not limited to the specific embodiments described herein.

What is claimed is:

1. A modular plunger packing gland assembly for a plunger of a frac pump, comprising:

an annular packing nut configured to be disposed circumferentially about the plunger and proximate a plurality of annular seals disposed about the plunger; and an annular packing gland having an inner circumferential threaded interface configured to engage an external circumferential thread defined on a head of the packing nut, the annular packing gland further defining a plurality of openings configured to receive a plurality of threaded bolts configured to securely fasten the annular packing gland and the packing nut to the frac pump, wherein the inner circumferential threaded interface is disposed around a portion of the packing nut having the largest outer diameter of the packing nut;

wherein the packing nut is disposed entirely within the annular packing gland.

2. The modular plunger packing gland assembly of claim 1, wherein the plurality of openings in the annular packing gland are distributed about a fluid bore opening of the frac pump in an offset manner.

3. The modular plunger packing gland assembly of claim 1, wherein the annular packing gland further defines a threaded pin opening configured to receive a threaded locking pin configured to exert force on an outer circumferential surface of the packing nut when the locking pin is fully inserted.

4. The modular plunger packing gland assembly of claim 1, further comprising an elongated sleeve configured for enveloping the plunger and maintained in position within a fluid bore of the frac pump by the annular packing gland.

5. The modular plunger packing gland assembly of claim 1, further comprising an elongated sleeve coupled to and integrated with the annular packing gland and configured for enveloping the plurality of annular seals within a fluid bore of the frac pump.

6. The modular plunger packing gland assembly of claim 5, wherein the annular packing gland further defines a lubrication port and a lubrication path.

7. The modular plunger packing gland assembly of claim 1, wherein an outer circumference of the annular packing gland further defines a groove to accommodate a sealing lubrication.

8. A packing gland assembly for a plunger bore of a hydraulic fracturing pump, comprising:

a packing nut; and a packing gland that is configured to be bolted onto a fluid end of the hydraulic fracturing pump, the packing gland including:

a sleeve that fits within the plunger bore and holds a packing within an internal passage of the sleeve;

an inner circumferential threaded interface outside an end of the sleeve and configured to engage an external thread defined on the packing nut; and a plurality of openings configured to receive respective bolts configured to bolt on the packing gland to the fluid end, wherein the packing nut is configured to be threaded to the inner circumferential threaded interface of the packing gland to engage the packing with an end portion of the packing nut that is inserted within the internal passage of the sleeve;

wherein the inner circumferential threaded interface is disposed around a portion of the packing nut having the largest outer diameter of the packing nut;

wherein the packing nut is disposed entirely within the packing gland.

9. The packing gland assembly of claim 8, wherein a groove for sealing lubrication is defined in an outer circumferential surface of the end portion of the packing nut.

10. The packing gland assembly of claim 8, wherein a groove for sealing lubrication is defined in an outer circumferential surface of the sleeve.

11. The packing gland assembly of claim 8, wherein the plurality of openings are distributed about the plunger bore in an offset pattern.

12. The packing gland assembly of claim 8, wherein the plurality of openings and the respective bolts are threaded.

13. The packing gland assembly of claim 8, further comprising a locking pin to be inserted through a pin opening defined in the packing gland and to exert force on the packing nut to prevent rotational movement between the packing nut and the packing gland.

* * * * *